United States Patent [19]

Salter et al.

[11] Patent Number: 4,886,278

[45] Date of Patent: Dec. 12, 1989

[54] GAME APARATUS

[76] Inventors: Avril M. Salter, 34 Lea Road, Wallasey, Merseyside, L44 0DU; John O'Reilly, 8, Worcester Road, Bidston, Birkenhead, Merseyside L43 7QB, both of England

[21] Appl. No.: 266,150

[22] Filed: Nov. 2, 1988

[30] Foreign Application Priority Data

Nov. 3, 1987 [GB] United Kingdom ..... 8725728

[51] Int. Cl.[4] ..... A63F 3/02

[52] U.S. Cl. ..... 273/242; 273/281; 273/282; 273/291

[58] Field of Search ..... 273/242, 258, 264, 267, 273/271, 281, 282, 291, 153 S, 160

[56] References Cited

U.S. PATENT DOCUMENTS

| | | | |
|---|---|---|---|
| 1,116,650 | 11/1914 | Waindle | 273/281 |
| 1,700,016 | 1/1929 | Belanger | 273/281 X |
| 2,398,726 | 4/1946 | Seguin | 273/282 X |
| 2,437,819 | 3/1948 | Heuser . | |
| 3,130,972 | 8/1960 | Schwarzlander . | |
| 4,074,907 | 2/1978 | Curtis . | |
| 4,470,601 | 9/1984 | Finn | 273/281 X |
| 4,486,017 | 12/1984 | Evert, Jr. | 273/281 X |

*Primary Examiner*—Edward M. Coven
*Assistant Examiner*—William E. Stoll
*Attorney, Agent, or Firm*—Foley & Lardner, Schwartz, Jeffery, Schwaab, Mack, Blumenthal & Evans

[57] ABSTRACT

An apparatus for playing a game comprising a board (1) and a plurality of playing pieces (6), the board defining at least two sets of intersecting grooves (2, 3), each intersection (4) forming a playing location during the playing of the game and the playing pieces (6) being locatable within the grooves (2, 3) so as to be slidably displaceable between the play locations.

6 Claims, 2 Drawing Sheets

GAME APARATUS

The present invention relates to an apparatus for playing a game in which at least two players are in direct competition with one another. More particularly, the present invention relates to an apparatus for playing a game in which a plurality of playing pieces are movable on a board in a manner which, although limited by predetermined rules, is determined by a player of the game rather than in a manner determined by external influences such as a random number indicator.

Games of this type, which are generally referred to as strategy-type games, are well known. The two best known games of this type are probably chess and draughts. Both of these games are so well known as to require no further explanation. However, both of these games have certain drawbacks.

Chess is a highly intellectual game and provides mental stimulation for millions of people. However, many people are deterred from even learning how to play chess by the apparent complexity of the game. As will be readily appreciated, there are six different playing pieces on each side in a game of chess and, before the game can be played, even at the lowest level, a player must learn how each of the different pieces is allowed to move. This drawback often manifests itself in young children who would, no doubt, enjoy playing chess but find the complexity of the different modes of movement somewhat difficult to grasp.

On the other hand, draughts is a more simple game in that, in general, the mode of movement of each playing piece is identical to all of the other playing pieces. However, such simplicity can often lead to the game becoming stereotyped and for players to lose interest in playing the game because it provides insufficient intellectual stimulation.

In both of these games, the aim of the game is to capture, in the case of chess, one specific piece of the other player and, in draughts, all of the playing pieces of the other player. In both games, each playing piece only has one life. In other words, if any playing piece is captured by the other player, the first mentioned piece is removed from the board and takes no further part in the game. This, particularly in the case of chess, can mean that one ill-advised move by one of the players effectively ruins any possible chance of winning the game.

The present invention seeks to provide an apparatus for playing a game which provides an adequate degree of mental stimulation for players of virtually any age and mental ability whilst simultaneously requiring little or no prior knowledge of the game.

According to the present invention, there is provided an apparatus for playing a game comprising a board and a plurality of playing pieces, the board defining at least two sets of intersecting grooves, each intersection forming a play location during the playing of the game, the playing pieces being locatable within said grooves so as to be slidably displaceable between play locations. Preferably, the grooves forming each set all extend parallel to one another. Desirably, the grooves in a first set extending substantially at right angles to the grooves in a second set. Advantageously, the grooves in each set have a different cross-sectional configuration and said playing pieces each include portions corresponding to each of said different cross-sectional configurations of said grooves.

Further preferably, one set of grooves has parallel side walls and a second set of grooves has stepped side walls.

Further preferably, each said playing piece includes at least two projection portions, the first of said projection portions corresponding to a first position of use and permitting sliding displacement of said playing piece along the grooves of each set and the second projection preventing, in a second position of use of the playing piece, sliding displacement of said playing piece along the grooves of at least one of the sets.

Still further preferably, the sets of grooves are disposed at right angles to one another so as to define ranks and files. In an alternative arrangement, the grooves are disposed at 45° to one another to define ranks, files and diagonals. In an advantageous embodiment of the invention, the board is square. However, if desired, the board may be rectangular or, indeed, any other shape.

Further preferably, each playing piece comprises a flat disc portion having two projections extending axially of the disc in opposed directions. In such an arrangement, it is desirable if one of the projections has a collar formed thereon so as to increase the diameter of said projection over a portion of its length.

Also according to the present invention, there is provided an apparatus for playing a game comprising a board defining at least two sets of intersecting grooves, each intersection forming a play location during the playing of the game, the grooves forming each set all extending parallel to one another, the grooves in a first said set extending at right angles to the grooves in a second said set and having an identical cross-section whilst the grooves in the second set have stepped side walls to define a first groove portion having a cross-section substantially equal to that of the grooves in the first set and a second groove portion of increased cross-section compared with that of the grooves in the first set; and a plurality of playing pieces each including at least two projection portions, the first of said projection portions corresponding to a first position of use and permitting sliding displacement of said playing piece between play locations along the grooves of each set and the second projection corresponding to a second position of use and permitting sliding displacement of said playing piece along the grooves of at least one of the sets whilst preventing such displacement along the grooves of at least one further set.

The invention will be further described, by way of example, with reference to the accompanying drawings, in which.

Figure 1:
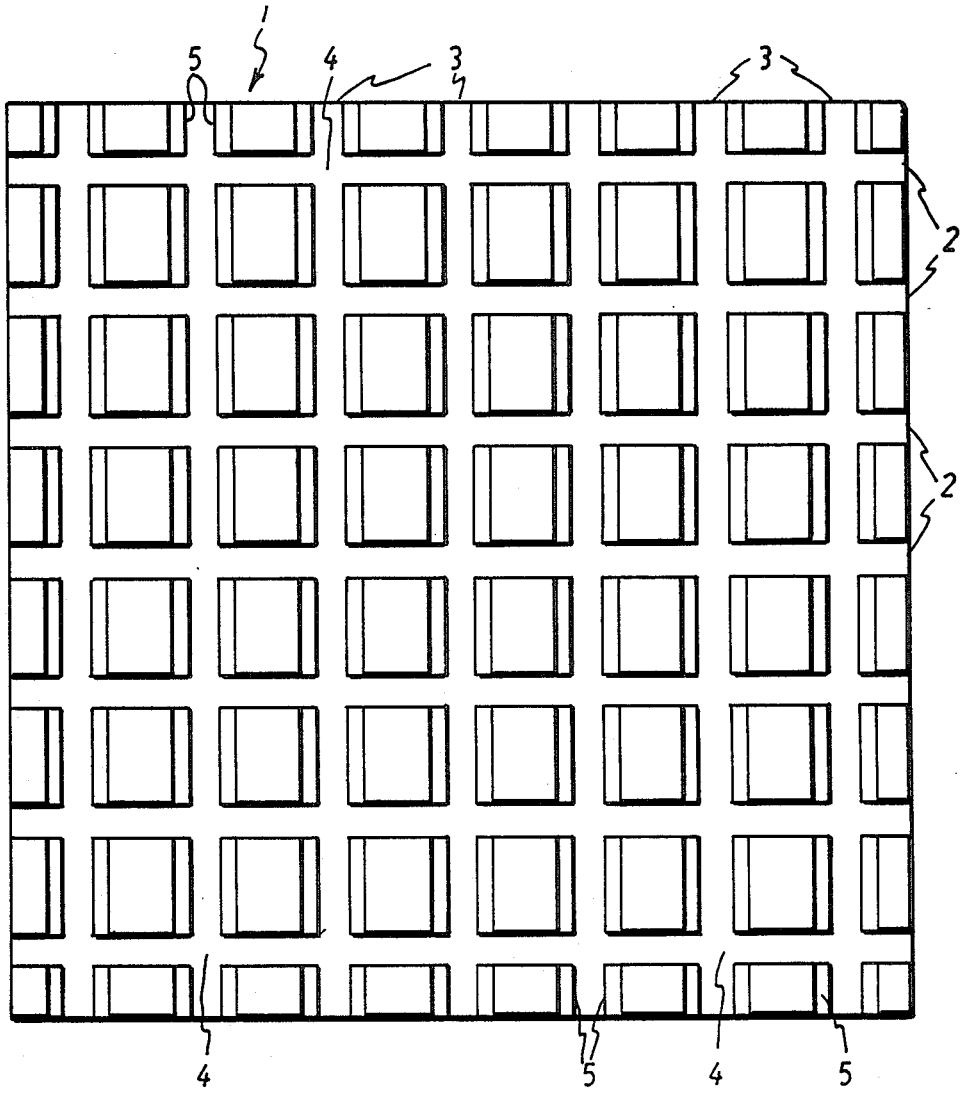
FIG. 1 is a plan view of a board forming part of a game apparatus in accordance with the present invention.

Referring now to the drawings, FIG. 1 shows a board 1 which is substantially square in shape. The board defines a first set of grooves 2 extending from side to side of the board to define ranks and a second set of grooves 3 extending from end to end of the board to define files. It will be seen that the sets of grooves 2 and 3 intersect one another at right angles. The points of intersection 4 of the grooves 2 and 3 constitute playing positions when the apparatus is being used.

Figure 2:
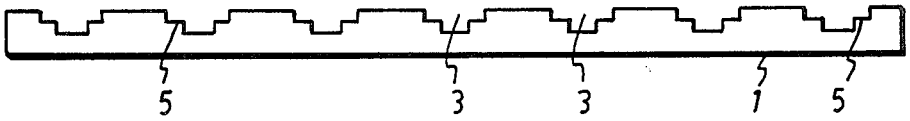
FIG. 2 is an elevational view of the board shown in FIG. 1 from one end.
Figure 3:
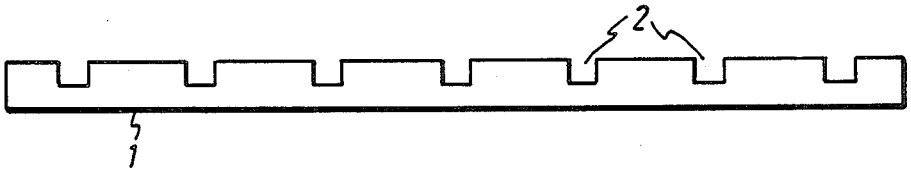
FIG. 3 is a side elevational view of the board shown in FIG. 1.

As will be seen from FIG. 2, each groove in the set 2 has a constant width. On the other hand, however, the grooves in the set 3 have a lower portion which has substantially the same width as that of the grooves in the set 1 but then has stepped side wall portions 5 to provide an upper portion of the groove 3 with a width which is greater than the width of the lower portion of the grooves 3 and hence of the grooves in the set 2.

Figure 4:
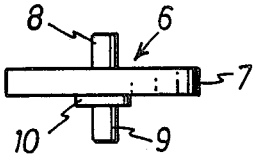
FIG. 4 is an elevational view of a playing piece forming part of the game apparatus according to the present invention and used with the board shown in FIGS. 1 to 3.

In FIG. 4, there is shown a playing piece 6 forming part of the game apparatus of the present invention. Such playing piece 6 comprises a central disc portion 7 having two projections 8 and 9 extending axially therefrom in opposed directions. The projection 8 is generally cylindrical. The projection 9 is also generally cylindrical but includes a collar portion 10 lying substantially adjacent the disc portion 7, which collar 10 has a diameter greater than the width of the grooves 2.

When the playing piece 6 is located on the board at one of the points of intersection 4 in such a manner that the projecting portion 8 extends downwardly, the piece 6 may be slidably displaced along either a groove in the set 2 or a groove in the set 3 with ease. If, however, the playing piece 6 is rotated through 180° such that the projection 9 and collar 10 extend downwardly, it may be slidably displaced along the grooves in the set 3 without difficulty because the cylindrical portion of the projection is located in the lower portion of the groove and the collar portion 10 sits upon the stepped portions of the groove. However, such playing piece, in this position, cannot be displaced along the grooves in the set 2 because the diameter of the collar is greater than the width of the groove. The reason for this will become apparent hereinafter when the method in which the game is played is described.

In playing the game, each of two players is allocated one end of the board and one set of playing pieces. The playing pieces in each set may be made distinguishable from one another by any suitable means, the most obvious being to make use of different colours. The number of pieces used in playing the game is not of major importance, nor are the number of grooves extending in each direction. However, for the sake of simplicity, reference will be made to the arrangement as shown in the drawings wherein there are seven ranks and seven files. Using such a board, it has been found most suitable to provide each player with ten playing pieces. The rank adjacent each player is defined as the base line of that player and one playing piece is provided at each intersection along such base line. The other three playing pieces of each player are disposed on the next rank in the second, fourth and sixth files. The first move by the first player comprises sliding one piece from one intersection 4 to a further intersection 4 which is either one or two intersections away from its original position and which has no playing piece located thereat. Alternatively, two playing pieces located at adjacent intersections in the same file may each be moved along that file a distance of one intersection each.

The second player then has his turn and the choice of moves open to him is identical to that of the first player. These allowed moves are, basically, the only moves which are permitted to each player during the entire game. However, during the course of the game, a player may find that he has two or more playing pieces located at adjacent intersections and extending in a straight line. Irrespective of the number of pieces in the line, all of the pieces in that line may be moved through one intersection in one of the directions in which the line extends. The object of the game is to form a line of two or more playing pieces and to move them into a position in which at least one of the pieces lies at an intersection adjacent to one which is occupied by an opponent's piece with the proviso that the piece in the chain lying adjacent the opponent's piece is capable of movement into the intersection occupied by the opponent's piece. When this occurs, the piece which has been touched is rotated through 180°. From the foregoing description, it will be readily apparent that the "caputured" piece is now restricted in its movement.

Such playing piece can now only be moved in a direction from end to end of the board, that is to say, along one of the files. If the captured piece is, itself, part of a chain on one of the ranks, that chain can no longer be moved along the rank because the captured piece cannot take part in such movement. If a piece is captured on two occasions, it is deemed to have lost its life and is removed from the board. The ultimate aim of the game for each player is to remove all of one's opponent's pieces from the board. Once one player has achieved this, the game is over. If a playing piece which has lost one of its directions of movement is moved onto the base rank of the opponent, it regains its lost direction of movement. In such circumstances, it will be readily apparent that to achieve this, the playing piece is rotated through 180°.

It will be readily apparent that minor modifications can be made to the game apparatus of the present invention without departing from the scope thereof. Thus, for example, the board may include grooves which extend diagonally. In such circumstances, the diagonally extending grooves will have a cross section different to that of the other two sets of grooves and the playing pieces will correspondingly have a first projection permitting movement in all three directions, a second projection which precludes that piece from moving in one of the three directions and a third projection which precludes movement in two of the three directions.

The present invention also relates to a computer when programmed to play such a game. Clearly, in such circumstances, intersecting grooves will not be provided. However, the program will place constraints upon the modes of movement of the pieces in dependence upon the "lives" which each piece has.

We claim:

1. An apparatus for playing a game comprising a board, said board comprising an upper surface defining a first set of grooves extending parallel to one another, and a second set of grooves extending parallel to one another, all of said grooves in each of said sets having an identical cross-sectional configuration relative to one another but different to the cross-sectional configuration of said grooves in said other set, said grooves in said first set intersecting said grooves in said second set, said intersections forming play locations, a plurality of playing pieces locatable within said grooves so as to be slidably displaceable between said play locations, each said playing piece comprising a body portion comprising at least first and second projection portions locatable in said grooves, said first projection portion corresponding to a first position of use and permitting sliding displacement of said playing piece along said grooves forming each of said sets, and said second projection portion corresponding to a second position of use and permitting sliding displacement of said playing pieces along said first set of grooves but precluding said sliding displacement along said second set of grooves.

2. An apparatus as claimed in claim 1, wherein said first set of grooves extends at right angles to said second set of grooves.

3. An apparatus as claimed in claim 1, wherein said first projection means of said playing piece has a cross-sectional configuration corresponding to said cross-sectional configuration of said first set of grooves, and said second projection means of said playing piece has a cross-sectional configuration corresponding to said cross-sectional configuration of said second set of grooves.

4. An apparatus as claimed in claim 1, wherein said first set of grooves has planar side walls and said second set of grooves has stepped side walls.

5. An apparatus as claimed in claim 1, wherein said playing piece further comprises a flat, disc portion carrying said first and second projection portions, said projection portions extending axially of said disc portion and in opposite directions to one another.

6. An apparatus as claimed in claim 6, wherein said first projection portion includes a collar portion so as to increase the diameter of said projection portion over a portion of its length.

* * * * *